US005992500A

United States Patent [19]

Schneider et al.

[11] Patent Number: 5,992,500

[45] Date of Patent: Nov. 30, 1999

[54] METHOD OF MAKING A CASTING HAVING A LOW DENSITY INSERT

[75] Inventors: Thomas P. Schneider, Canton, Mich.; John L. Jorstad, Richmond, Va.

[73] Assignee: CMI International, Inc., Southfield, Mich.

[21] Appl. No.: 08/633,101

[22] Filed: Apr. 16, 1996

[51] Int. Cl.[6] ..... B22D 19/00

[52] U.S. Cl. ..... 164/98; 164/79

[58] Field of Search ..... 164/79, 98

[56] References Cited

U.S. PATENT DOCUMENTS

| | | | |
|---|---|---|---|
| 2,935,396 | 5/1960 | Pashak . | |
| 3,214,265 | 10/1965 | Fiedler . | |
| 3,275,424 | 9/1966 | Kuchek . | |
| 3,756,303 | 9/1973 | Valdo . | |
| 3,873,392 | 3/1975 | Niebyiski et al. . | |
| 4,008,747 | 2/1977 | Devers et al. . | |
| 4,314,835 | 2/1982 | Pelton | 164/79 |
| 4,446,906 | 5/1984 | Ackerman et al. . | |
| 4,491,168 | 1/1985 | Snee . | |
| 4,691,754 | 9/1987 | Trumbauer et al. . | |
| 5,221,324 | 6/1993 | Jin et al. . | |
| 5,341,866 | 8/1994 | Munro | 164/97 |
| 5,394,930 | 3/1995 | Kennerknecht . | |

FOREIGN PATENT DOCUMENTS

| | | | |
|---|---|---|---|
| 474332 | 3/1992 | European Pat. Off. | 164/98 |
| 55-158944 | 5/1979 | Japan . | |
| 63-192549 | 8/1988 | Japan | 164/98 |
| 63-242461 | 10/1988 | Japan | 164/98 |
| 7210107 | 7/1972 | Netherlands . | |
| 920042 | 3/1963 | United Kingdom . | |

OTHER PUBLICATIONS

Practice & Management (PMI vol. 25, No. 4, 1993); "P/M Technology for the Production of Metal Foams" by H.–D. Kunze, J. Baumeister, J. Banhart, and M. Weber.

Mepura Metallpulvergesellschaft m.b.H. Ranshofen; "Alulight" Advertisement Materials (Jun. 1996).

*Primary Examiner*—Kuang Y. Lin

*Attorney, Agent, or Firm*—Howard & Howard

[57] ABSTRACT

A composite metallic cast article (A) includes a shell (28) having a predetermined solid phase density. A non removable insert (24) is at least partially embedded within the shell (28). The insert (24) is fabricated from a foamed metal substance having a substantially lower solid phase density than the shell (28). The foamed metal insert (24) may have a layer of skin (26) fused with the molten metal of the shell (28) during the casting process. Tapered locating pins (30) or other spacing elements position the insert (24) within the mold cavity (18) to prevent shift during the casting operation. The foamed metal insert (24) reduces the time and expense involved in removing a traditional casting core after the casting operation is complete. Also, the insert (24) can be completely enclosed within the shell (28) of the article (A), thereby expanding the design capabilities of such cast articles (A). Furthermore, the foamed metal insert (24) provides better stiffness and energy absorbsion to the cast article (A) when compared with a hollow cavity section formed by a core of the prior art.

4 Claims, 2 Drawing Sheets

FIG-3
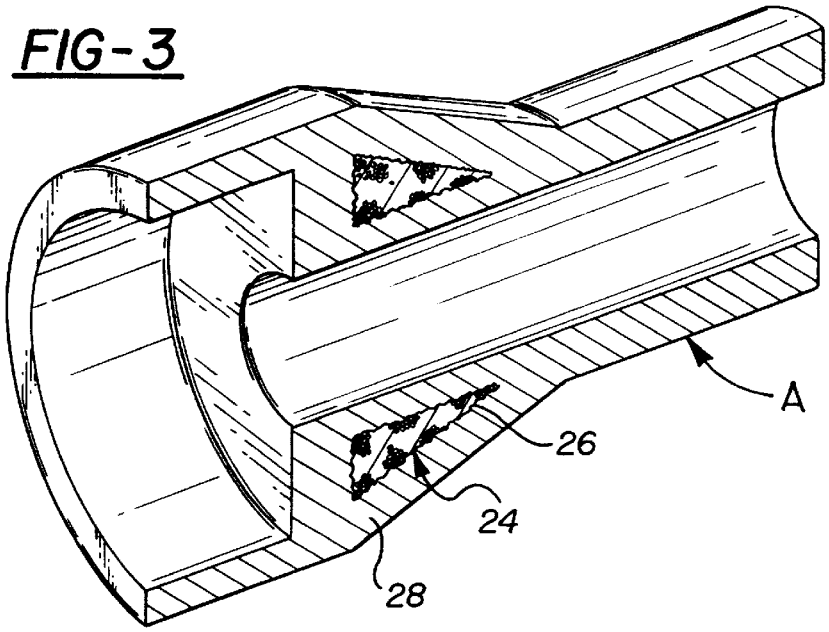
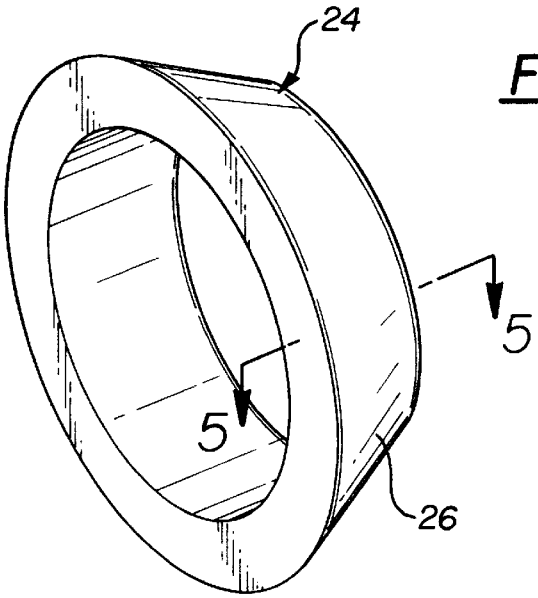
FIG-4
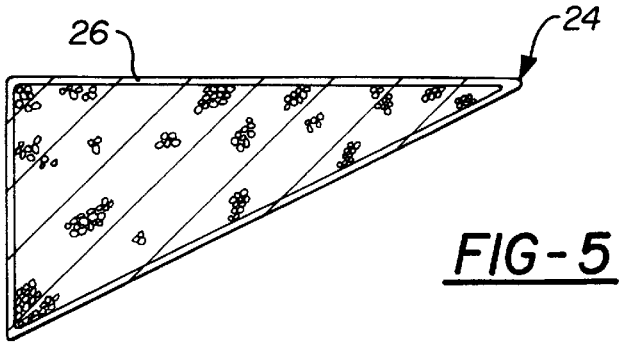
FIG-5

METHOD OF MAKING A CASTING HAVING A LOW DENSITY INSERT

TECHNICAL FIELD

The subject invention relates generally to cast metallic objects with at least a partially encapsulated insert made of a very low density material. More specifically, the invention is directed to a cast aluminum or magnesium article having an embedded insert made of foamed or sponged aluminum forming a structurally fortified cavity therein.

BACKGROUND OF THE INVENTION

Metal casting processes, and in particular aluminum and magnesium casting processes, are often used to create a finished object having a hollow interior cavity. This is done primarily to reduce the weight of the finished article and to reduce cost by conserving casting material.

Hollow interior cavities are formed by placing a core in a casting mold prior to introducing the molten metal. After the molding operation, the core is removed by either disintegration (in the case of resin bonded sand cores), melt-down (in the case of metallic cores) or other techniques known to those skilled in the art. This core removal process is time consuming and sometimes expensive depending upon the type of core material used and the removal process employed.

Another drawback of this metal casting process is that the interior cavity must be partially exposed or else a passage must be provided for removal of the core after the casting process is complete. Therefore, the design of the interior cavity shape and placement of the cavity are often dictated more by considerations of core removal than of application and performance of the article in use. Furthermore, while the prior art hollow interior cavity is effective in reducing weight and material costs, it provides no structural support to the article.

SUMMARY OF THE INVENTION AND ADVANTAGES

The subject invention comprises a composite metallic cast article having a shell. The shell is made from a metallic substance having a predetermined solid phase density. A non removable insert is at least partially embedded within the shell. The insert is fabricated from a foamed metal substance having a substantially lower solid phase density than the solid phase density of the shell.

The subject invention also comprises a method for casting a composite article by the steps of providing a metal casting mold cavity, preforming the insert from a low density foamed metal material, positioning the insert within the mold cavity, filling the mold cavity with a molten metallic substance, and solidifying the metallic substance in the cavity to form a shell at least partially enveloping the insert.

The improvement of the subject invention resides in the use of foamed metal for a permanent (non removable) insert, thereby allowing it to remain permanently encapsulated or embedded in the article. This has several advantages, such as reducing the time and expense required to form a finished cast article because a core does not need to be removed after the casting operation is complete. Also, the insert of the subject invention can be completely enclosed within the shell of the article, such that special passages or design considerations for subsequent core removal are not required. Furthermore, foamed metal has certain properties and characteristics which enhance the structural integrity of the article. Most notably, the foamed metal insert will provide better stiffness and energy absorption to the cast article than would a totally hollow cavity section formed by a core of the prior art. Therefore, the subject invention can be applied for use in cast articles subject to high stress and loading.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a perspective view in cross section of a metallic cast article having an embedded foamed metal insert according to the subject invention;

FIG. 4 is a perspective view of a preformed foamed metal insert according to the subject invention; and FIG. 5 is a cross-sectional view of the foamed metal insert taken along line 5—5 of FIG. 4.

DETAILED DESCRIPTION OF THE PREFERRED EMBODIMENT

Figure 1:
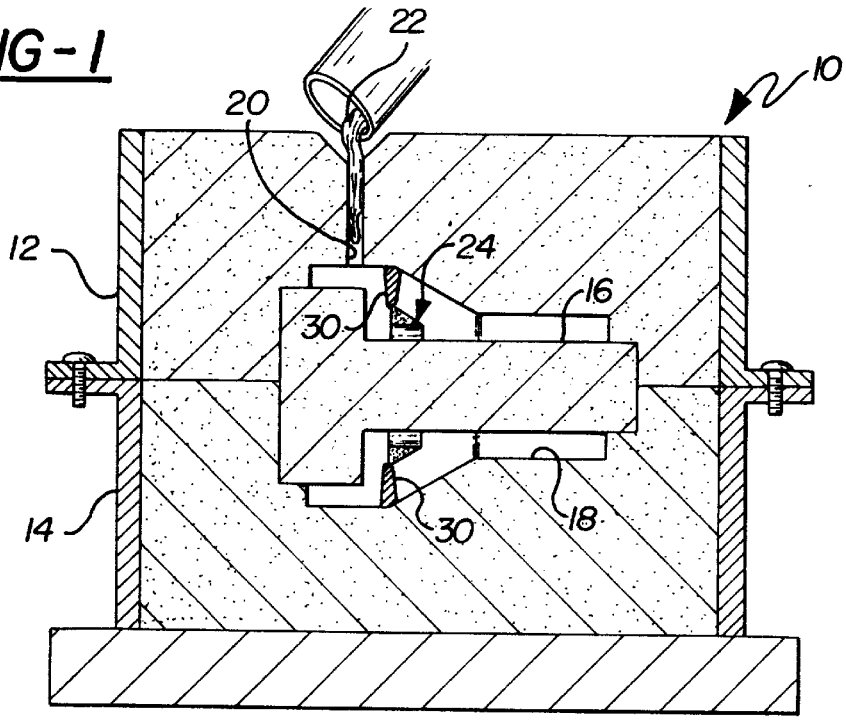
FIG. 1 is a simplified cross-sectional view showing molten metal being introduced into a mold cavity according to the subject invention.

Referring to the Figures, wherein like numerals indicate like or corresponding parts throughout the several views, a metal casting mold assembly is generally indicated at 10. The mold assembly 10 is of the type for casting a composite article A, preferably from aluminum and/or magnesium materials. The mold assembly 10 is generally of the type well know to include a pair of mold halves 12, 14 which may be either of the sand type, the permanent metal type, ceramic investment type, or any other type in which the casting of metallic articles, preferably from aluminum or magnesium, may take place. The assembly 10 shown in FIG. 1 is for illustrative purposes only. Depending upon the shape of the article A to be molded, the mold assembly 10 may also include a casting core 16 seated between the mold halves 12, 14. The core 16 together with the mold halves 12, 14 form an interior mold cavity 18 which is accessed through a sprue passage 20 for the introduction of molten metal 22 (preferably aluminum or magnesium), as shown in FIG. 1. The mold cavity 18 includes internal walls which define the surface shape and texture of the article A.

Prior to introducing the molten metal into the mold cavity 18, an insert, generally indicated at 24, is positioned within the mold cavity 18 in a strategic, predetermined position that would otherwise be intended for an additional casting core to form a hollow cavity in the article A. However, the insert 24 is not removed from the article A as would a traditional casting core, and forms a permanent inclusion in the article A.

The insert 24 is fabricated from a low density foamed metal material of the type disclosed in U.S. Pat. No. 5,221,324 to Jin et al., issued Jun. 22, 1993, the disclosure of which is hereby incorporated by reference. According to the preferred embodiment, the foamed metal consists essentially of aluminum or an aluminum alloy (but may also consist essentially of magnesium or a magnesium alloy) and is formed to include an array of either open (sponge) or closed (foam) cells. Preferably, but not necessarily, the insert 24 is preformed to a final or net shape in an earlier operation such that a nonporous skin 26 forms completely about the exterior surfaces of the cellular array. This skin 26 helps limit over absorption or infusion of the molten metal 22 into the interstices of the insert 24.

As the molten metal 22 is poured or otherwise introduced into the mold cavity 18, it contacts the skin 26 of the insert 24 and causes shallow or localized melting of the skin 26. In this manner, the skin 26 (and perhaps a few layers of cells in the foamed metal) fuses together with the molten metal 22, forming a good mechanical bond. Once solidified, the molten metal 22 forms a shell 28 about the exterior of the article A, in which the insert 24 is embedded. In some design instances, it might be desirable to partially expose the insert 24 through the exterior of the shell 28. The solid phase density of the foamed metal insert 24 is substantially lower than the solid phase density of the shell 28. Therefore, substantial weight and cost savings can be realized by use of the insert 24.

Alternatively, some applications of the invention may require ehanced bonding between the insert 24 and the shell 28, in which case it may be desirable to eliminate the skin 26 so that the surface cells are more readily infiltrated by the molten metal 22. When the skin 26 is eliminated, it is advisable to use closed cells. In still other alternative applications, it may not be desirable to have any bonding between the skin 26 and the shell 28. In these instances, the insert 24 will still provide structural support to the article A due to its encapsulation therein.

Figure 2:
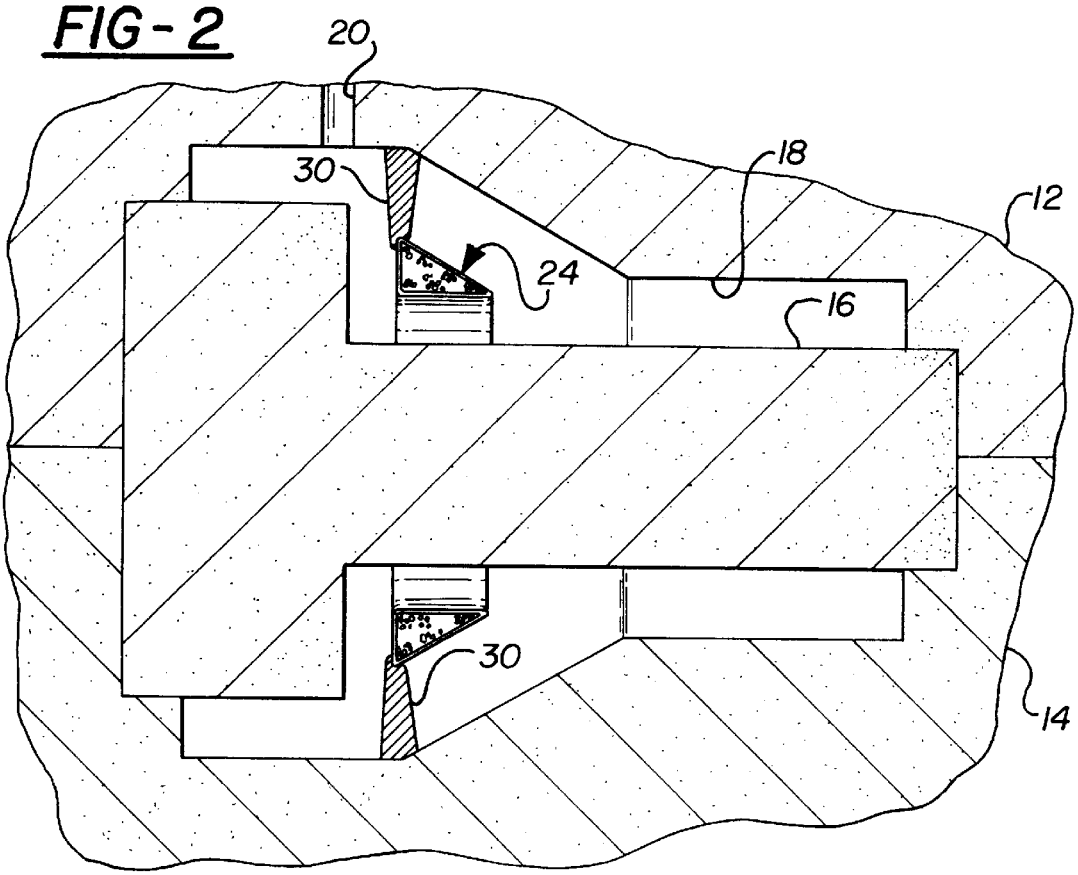
FIG. 2 is a fragmentary cross-sectional view of the metal casting mold cavity and insert.

Depending upon the shape of the article A, the shape and intended location of the insert 24, and other design factors, it may be necessary to maintain a preestablished spacing between the walls of the mold cavity 18 and the insert 24 while the molten metal 22 is being introduced. In other words, it may be necessary to locate the insert in the mold cavity so that it does not shift out of position during casting. The insert 24 can be located in the mold cavity 24 in any conventional manner known to those skilled in the art. For example, tapered locating pins 30 can be attached within the mold cavity 18, as shown in FIGS. 1 and 2. Alternatively, aluminum chaplets (not shown) can be formed as part of the insert 24 during its preforming operation or attached in a subsequent operation. Also, the insert 24 can be held in position by conventional core prints if it will not be totally enclosed within the shell 28.

The use of foamed metal for the permanent (non removable) insert 24 has many advantages, such as reducing the time and expense involved in removing a traditional (prior art) casting core after the casting operation is complete. Also, the insert 24 of the subject invention can be completely enclosed within the shell 28 of the article A, thereby expanding the design capabilities of such cast articles A. Furthermore, the foamed metal insert 24 will provide better stiffness and energy absorbsion to the cast article A than would a totally hollow cavity section formed by a core of the prior art.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method for casting a composite article (A) comprising the steps of:

providing a metal casting mold cavity (18);

positioning an insert (24) within the mold cavity (18);

filling the mold cavity (18) with a molten metallic substance (22);

solidifying the metallic substance (22) in the cavity (18) to form a shell (28) at least partially enveloping the insert (24);

and characterized by preforming the insert (24) from a low density foamed metal material;

said preforming the insert (24) including forming a nonporous preformed skin (26) and fusing the skin (26) of the insert (24) to the shell (28).

2. A method as set forth in claim 1 wherein said preforming the insert (24) includes forming an array of included cells.

3. A method as set forth in claim 1 further including positioning spacers between the insert (24) and the internal walls of the mold cavity (18) to maintain a spacing during the casting process.

4. A method as set forth in claim 1 wherein the mold cavity (18) includes internal walls, and said positioning the insert (24) within the mold cavity (18) includes spacing the insert (24) away from the walls.

* * * * *